US008343432B2

(12) United States Patent
Endou et al.

(10) Patent No.: US 8,343,432 B2
(45) Date of Patent: Jan. 1, 2013

(54) WASTE DECOMPOSITION APPARATUS

(75) Inventors: Mitsuo Endou, Shizuoka-Ken (JP); Yoshinori Yoshida, Kanagawa-Ken (JP); Goda Toshihisa, Kanagawa-Ken (JP); Tojo Toshiaki, Saitama-Ken (JP)

(73) Assignee: Jae Yong Lee (KR)

( * ) Notice: Subject to any disclaimer, the term of this patent is extended or adjusted under 35 U.S.C. 154(b) by 590 days.

(21) Appl. No.: 12/356,692

(22) Filed: Jan. 21, 2009

(65) Prior Publication Data

US 2009/0199728 A1 Aug. 13, 2009

(30) Foreign Application Priority Data

Jan. 22, 2008 (JP) ..... 2008-11160

(51) Int. Cl.
*B01J 19/08* (2006.01)

(52) U.S. Cl. ..... 422/186.01; 588/19

(58) Field of Classification Search ..... 422/186.01; 588/306, 19; 204/155
See application file for complete search history.

(56) References Cited

U.S. PATENT DOCUMENTS 3,670,669 A * 6/1972 Hoad ..... 110/220
5,817,954 A * 10/1998 Kahng et al. ..... 73/863.84

FOREIGN PATENT DOCUMENTS

| | | | |
|---|---|---|---|
| JP | 2001-304520 | A | 10/2001 |
| JP | 2003-193061 | A | 7/2003 |
| JP | 2006-341245 | A | 12/2006 |
| JP | 2007-209843 | A | 8/2007 |
| KR | 10-0413041 | | 12/2003 |

* cited by examiner

*Primary Examiner* — Natalia Levkovich
(74) *Attorney, Agent, or Firm* — Wilmer Cutler Pickering Hale & Dorr LLP.

(57) ABSTRACT

A waste decomposition apparatus has a container-shaped body, a waste inlet for introducing wastes into the body, an outlet for discharging residual ash out of the body after the wastes introduced into the body are decomposed, and magnetic functioning means for inducing magnetic fields in the wastes introduced into the body. The waste decomposition apparatus includes pressing means for pressing the wastes introduced into the body.

9 Claims, 5 Drawing Sheets

WASTE DECOMPOSITION APPARATUS

CROSS-REFERENCE TO RELATED APPLICATIONS

This application claims benefit of Japanese Patent Application No. 2008-11160 filed on Jan. 22, 2008.

BACKGROUND OF THE INVENTION

1. Field of the Invention

The present invention relates to a waste decomposition apparatus which thermally decomposes organic wastes by magnetic functioning means.

2. Description of the Related Art

In general, an incinerator and a melting furnace are known as facilities for processing organic wastes. The problems caused by the processing of wastes using the incinerator and the melting furnace include the production of dioxin. As measures for preventing production of dioxin, a method can be adopted, in which a secondary combustion chamber is provided such that the internal temperature of a furnace can be maintained at a predetermined temperature greater than 800° C. However, the method requires a substantial amount of facility costs and a fuel cost due to the use of heavy oil.

For this reason, recently, waste processing apparatuses for thermally decomposing and processing wastes using magnetic functioning means have been disclosed in the art (for example, see Patent Documents 1, 2 and 3 given below). In these waste processing apparatuses, by sucking magnetized air into a furnace, wastes have an increased temperature and are thermally decomposed to be carbonized and ashed. As a consequence, in the waste processing apparatuses for thermally decomposing and processing wastes using magnetic functioning means, it is possible to completely bum wastes without the need of providing a secondary combustion chamber or maintaining the high internal temperature of a furnace over 800° C.

Nevertheless, even in these waste processing apparatuses, it is keenly demanded to shorten a processing time or ensure reliable ashing of wastes.

[Patent Document 1] Japanese Unexamined Patent Publication No. 2006-341245

[Patent Document 2] Japanese Unexamined Patent Publication No. 2003-193061

[Patent Document 3] Japanese Unexamined Patent Publication No. 2007-209843

SUMMARY OF THE INVENTION

Accordingly, the present invention has been made in an effort to solve the problems occurring in the related art, and an object of the present invention is to provide a waste processing apparatus which can thermally decompose and process wastes using novel magnetic functioning means capable of reliably ashing the wastes and shortening a processing time.

In order to achieve the above object, according to one aspect of the present invention, there is provided a waste decomposition apparatus having a container-shaped body, a waste inlet for introducing wastes into the body, an outlet for discharging residual ash out of the body after the wastes introduced into the body are decomposed, and magnetic functioning means for inducing magnetic fields in the wastes introduced into the body, wherein the waste decomposition apparatus includes pressing means for pressing the wastes introduced into the body.

According to another aspect of the present invention, the pressing means comprises a weight member which is disposed in the body and raising and lowering means for raising and lowering the weight member.

According to another aspect of the present invention, the magnetic functioning means comprises an air introduction pipe for introducing outside air into the body and magnets installed on the air introduction pipe.

According to another aspect of the present invention, in addition to the magnetic functioning means comprising the air introduction pipe and the magnets, another magnetic functioning means is received in the weight member.

According to still another aspect of the present invention, in addition to the magnetic functioning means comprising the air introduction pipe and the magnets, still another magnetic functioning means is received in a space defined in a bottom of the body.

According to a still further aspect of the present invention, the magnetic functioning means received in the weight member and the bottom of the body comprise magnetized ash of wastes.

In the waste processing apparatus according to the present invention, since wastes are decomposed not by combustion as in an incinerator but by magnetic vibration, the production of dioxin can be minimized. Accordingly, the facility costs can be reduced because a secondary combustion chamber as in an incinerator is not required, and the running costs can be reduced because an auxiliary fuel is not needed. Also, since pressing means for pressing wastes accommodated in the body of the waste processing apparatus is provided, the wastes can be reliably ashed and the time for ashing the wastes can be shortened.

In the case that the pressing means is composed of a weight member disposed in the body of the waste processing apparatus and vertical moving means for raising and lowering the weight member, it is possible to always apply a predetermined pressure to the wastes using a simple structure when processing the wastes by decreasing the volume of wastes through decomposition processing.

In the case that magnetic functioning means is composed of air introduction pipes through which outside air is introduced into the body of the waste processing apparatus and magnets which are installed on the air introduction pipes, it is possible to reliably and efficiently introduce magnetized air into the body of the waste processing apparatus.

In the case that magnetic functioning means is received in the weight member for pressing wastes, because the magnetic functioning means can always be positioned close to the wastes, it is possible to stably induce powerful magnetic fields in the wastes.

Further, in the case that magnetic functioning means is received in the space defined in the bottom of the body of the waste processing apparatus, it is possible to stably maintain powerful magnetic fields in the body of the waste processing apparatus.

Moreover, in the case that the residual ash of magnetized wastes is used as the magnetic functioning means received in the weight member and the bottom of the body of the waste processing apparatus, it is possible to constitute the magnetic functioning means at reduced costs.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
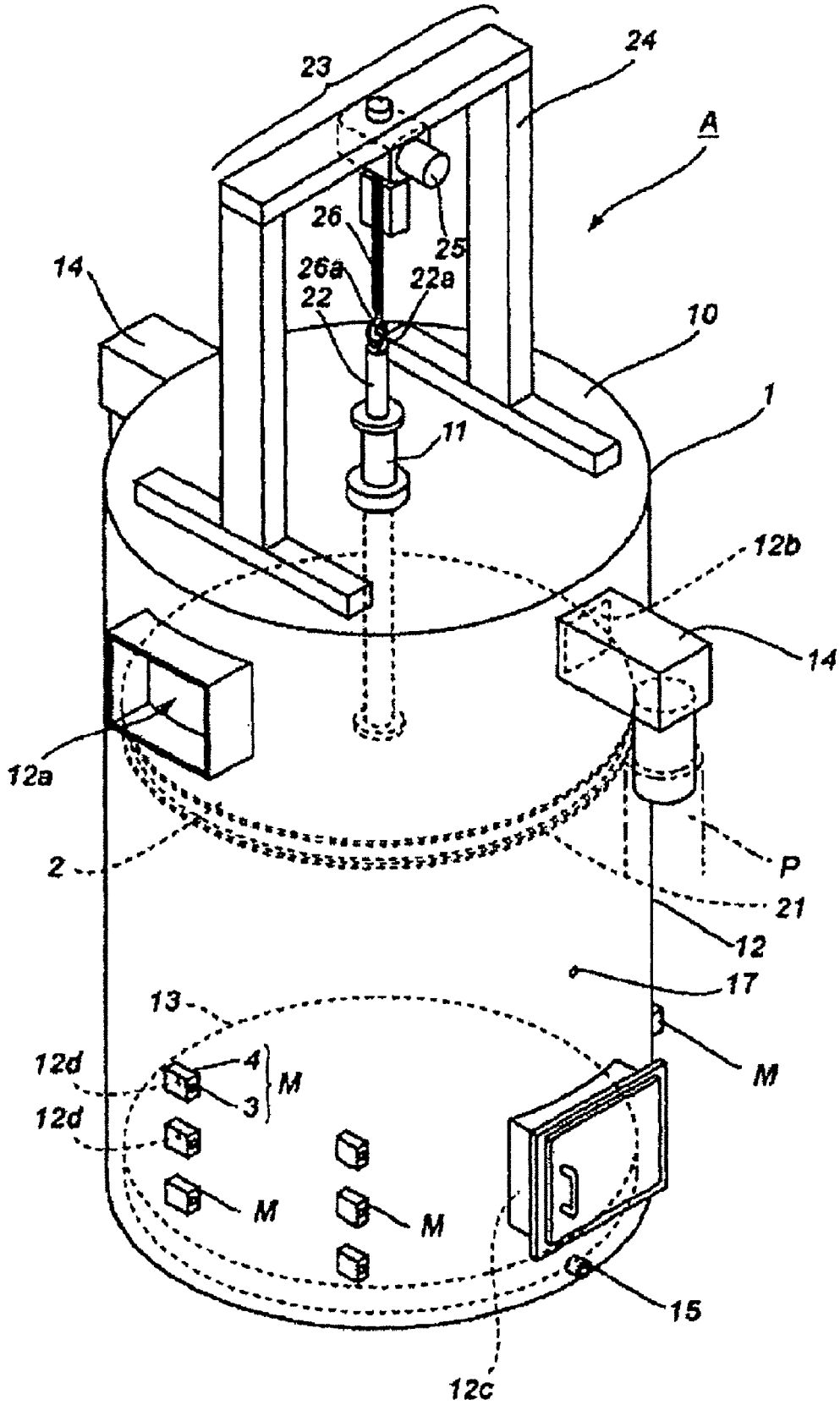
FIG. 1 is a perspective view illustrating a waste processing apparatus in accordance with an embodiment of the present invention.
Figure 2:
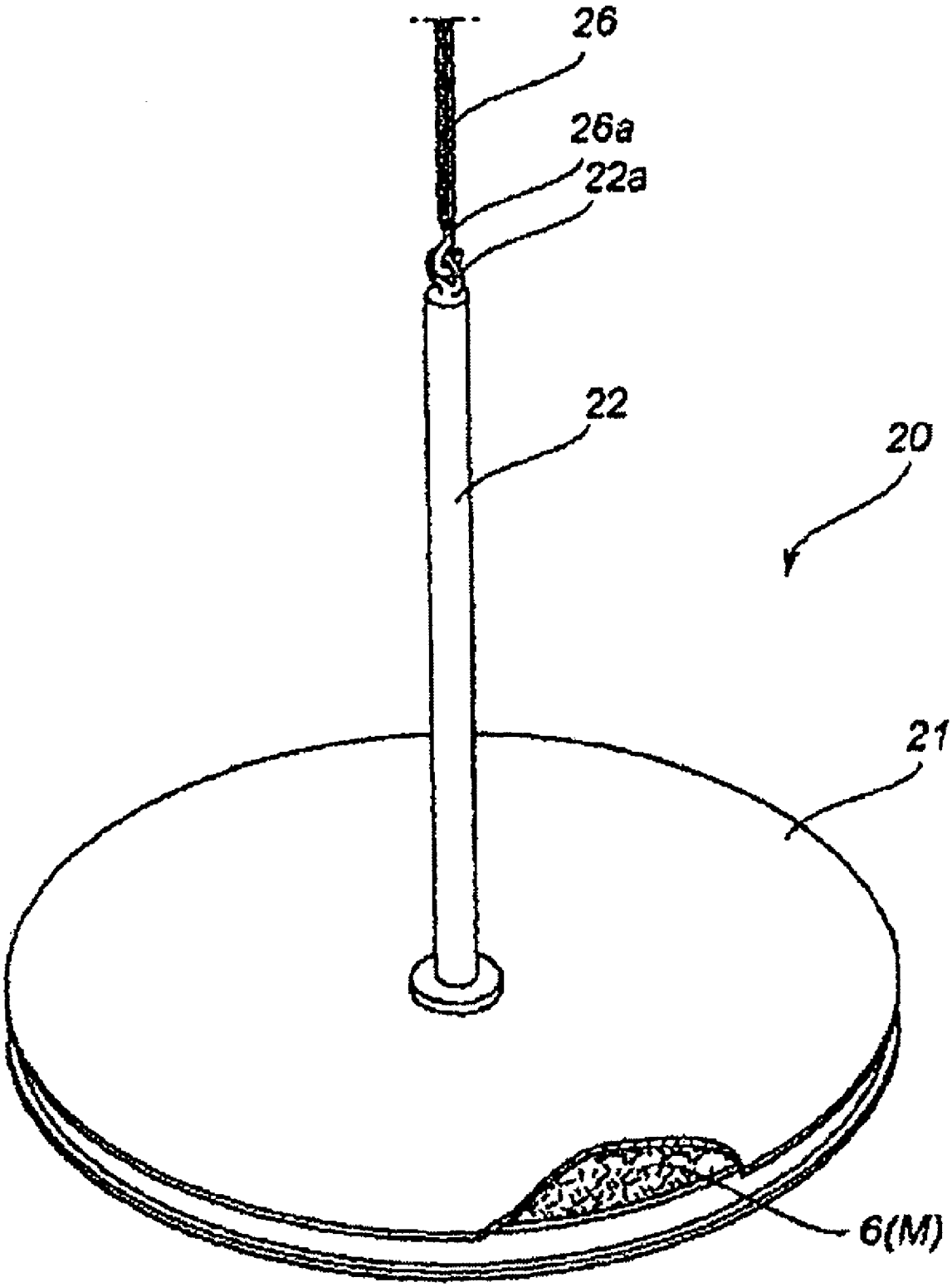
FIG. 2 is a partially broken-away perspective view illustrating a weight member of pressing means.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIG. 1, a waste decomposition apparatus A includes a container-shaped body 1 to which wastes are to be introduced, magnetic functioning means M which apply magnetic force to the wastes accommodated in the body 1, and pressing means 2 which presses the wastes accommodated in the body 1.

The body 1 has the configuration of a cylindrical container. A top wall 10 is formed on the upper end of the body 1. An insertion hole is defined through the center portion of the top wall 10 such that a vertical movement rod 22 of the pressing means 2 can be inserted through the insertion hole into the body 1. A guide pipe 11 is secured to the top wall 10 to slidably guide the movement of the vertical movement rod 22.

A waste inlet 12*a* is defined through the upper portion of a sidewall 12 of the body 1. Also, two gas outlets 12*b* are oppositely defined through the upper portion of the sidewall 12 of the body 1 so that the gas produced when decomposing and processing wastes can be discharged through the gas outlets 12*b*. Gas discharge pipes 14 are connected to the gas outlets 12*b*, and a piping system P is connected to the gas discharge pipes 14 so that the gas can be directed toward a filter. Further, an automatic waste supplier such as a bucket conveyor (not shown) is installed in the waste inlet 12*a*.

Two discharge openings 12*c* for discharging decomposed and ashed wastes are oppositely defined through the lower portion of the sidewall 12 of the body 1. A plurality of air inlets 12*d* in which magnetic functioning means M are installed are defined through the lower portion of the sidewall 12 of the body 1. A temperature sensor 17 is installed below the middle portion of the sidewall 12. In this regard, the sidewall 12 has a double-walled structure so that the thermal insulation characteristic of the body 1 can be improved. Plates are installed on the bottom of the body 1 to have a double-walled structure, and magnetic functioning means M is received in a space S defined between the plates. Two liquid discharge holes are defined through the sidewall 12 adjacent to the lower end of the body 1, and liquid discharge pipes 15 are respectively connected to the two liquid discharge holes. A plurality of stoppers 16 are secured to the inner surface of the sidewall 12 of the body 1 at a position higher than the discharge openings 12*c*. The stoppers 16 prevent a weight member 20 of the pressing means 2 from being lowered beyond a predetermined limit.

Next, the pressing means 2 will be described. The pressing means 2 comprises the weight member 20 which is disposed in the body 1 and is brought into direct contact with wastes to press the wastes downward, and raising and lowering means 23 which vertically raises and lowers the weight member 20.

The weight member 20 is composed of a pressing plate 21 having the shape of a disc and a vertical movement rod 22 which is installed to be vertically erected at the center of the pressing plate 21. The pressing plate 21 has a hollow sectional shape, and magnetic functioning means M which will be described later is received in the pressing plate 21. An engagement ring 22*a* is secured to the upper end of the vertical movement rod 22 to be engaged with the raising and lowering means 23.

In the weight member 20 having the shape as described above, the pressing plate 21 is horizontally disposed in the body 1, and the vertical movement rod 22 is inserted through the guide pipe 11 which is secured to the center portion of the top wall 10 of the body 1.

The raising and lowering means 23 is composed of a rod support 24 which is formed in the shape of a frame member, such as a door frame, on the upper end of the body 1, a winding unit 25 which is installed on the rod support 24, and a chain 26 which can be wound on the winding unit 25.

For example, the winding unit 25 is composed of a driving motor and a winding drum. An engagement hook 26*a* is provided to the distal end of the chain 26 to be engaged with the engagement ring 22*a* which is provided to the upper end of the vertical movement rod 22 of the weight member 20.

The magnetic functioning means M will be described below. For instance, the magnetic functioning means M are provided in the air inlets 12*d* which are defined through the sidewall 12 of the body 1, in the space S which is defined in the bottom of the body 1, and in a space which is defined in the weight member 20 of the pressing means 2.

Figure 3:
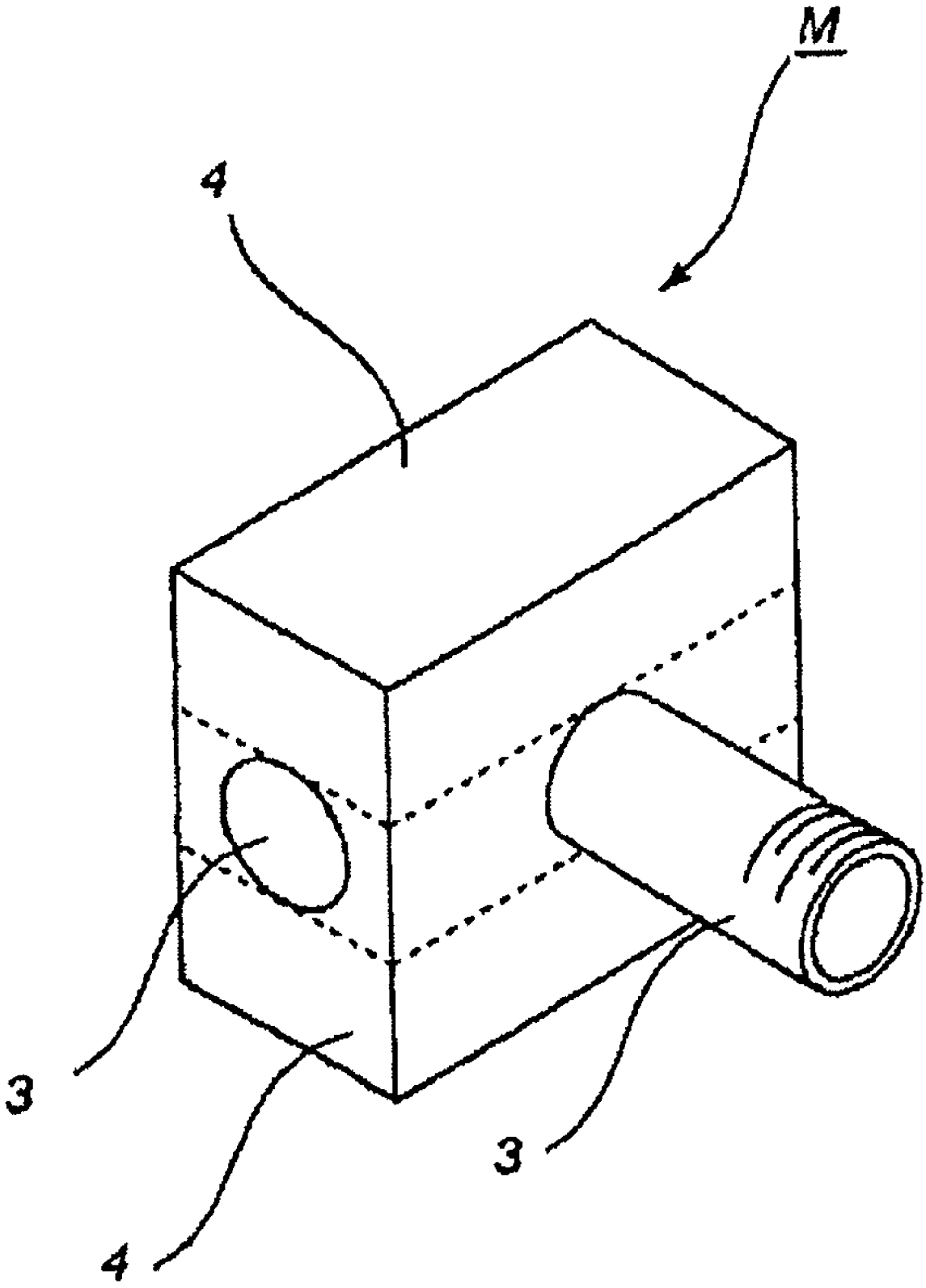
FIG. 3 is a perspective view illustrating magnetic functioning means composed of air introduction pipes and magnets.

Stating the magnetic functioning means M arranged in the air inlets 12*d*, air introduction pipes 3 are connected to the air inlets 12*d* as shown in FIG. 3, and magnets 4 are installed on the air introduction pipes 3. For example, the magnets 4 comprise permanent magnets. The magnets 4 are arranged such that the S and N poles of the magnets 4 face each other. As the magnets 4, linear electromagnets can be used in place of the permanent magnets. A piping (not shown) is connected to the air introduction pipes 3.

Stating the magnetic functioning means M received in the space S defined in the bottom of the body 1, magnetic ceramic 5 made of magnetized ceramic ash is filled in the space S defined in the bottom of the body 1. In detail, the magnetic ceramic 5 is prepared using the ash obtained by magnetizing the wastes processed by the waste decomposition apparatus A according to the present invention.

Stating the magnetic functioning means M received in the weight member 20 of the pressing means 2, magnetic ceramic 6 made of magnetized ceramic ash is filled in the pressing plate 21 of the weight member 20. In detail, the magnetic ceramic 6 is also prepared using the ash obtained by magnetizing the wastes processed by the waste decomposition apparatus A according to the present invention.

Hereafter, the operation of the waste decomposition apparatus A according to the present invention, constructed as mentioned above, will be described in detail.

First, magnetic vibrations are induced in the body 1 due to the introduction of magnetized air through the air inlets 12*d* and by the magnetic functioning means M received in the weight member 20 and the magnetic functioning means M received in the bottom of the body 1.

Figure 4:
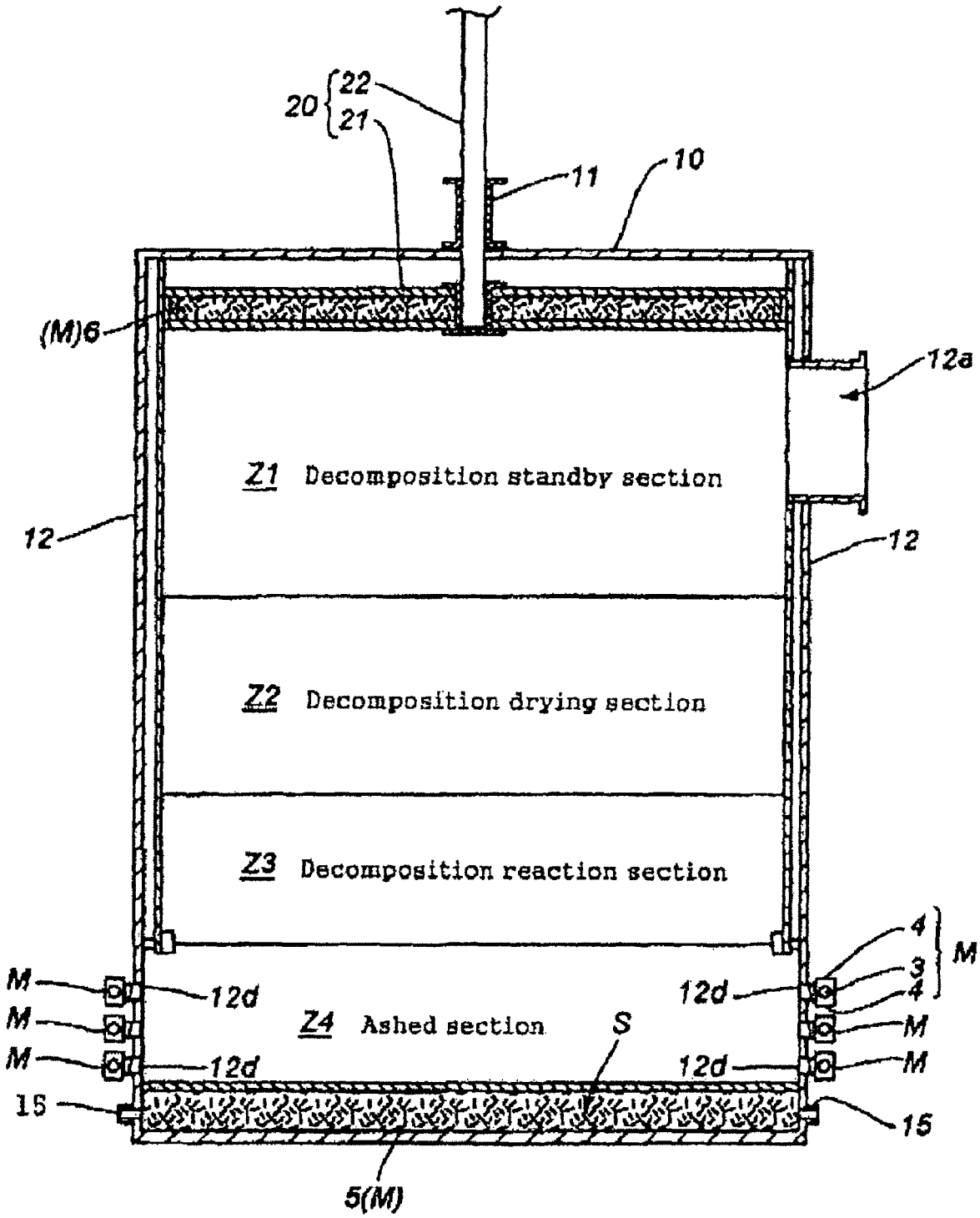
FIG. 4 is an explanatory view illustrating a decomposition processing state in the body of the waste processing apparatus.

If wastes are newly introduced into the body 1 by the automatic waste supplier, the wastes are accommodated in a decomposition standby section Z1 which is defined in the uppermost part of the body 1 in FIG. 4. When the wastes are introduced into the body 1, the weight member 20 is raised upward by the raising and lowering means 23.

Figure 5:
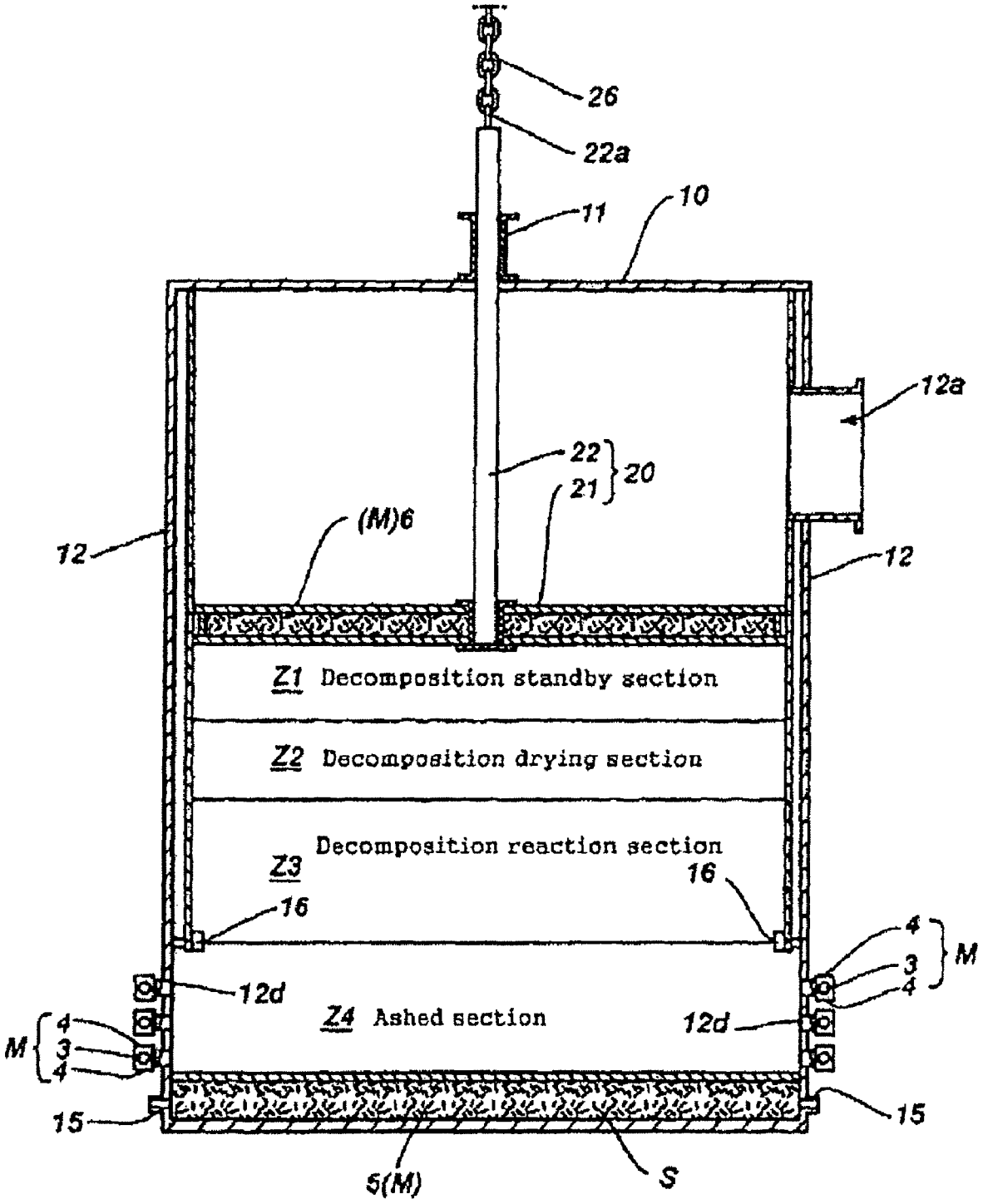
FIG. 5 is an explanatory view illustrating another decomposition processing state in the body of the waste processing apparatus.

In order to decrease the volume of the decomposed portion of wastes, the wastes existing in the decomposition standby section Z1 are pressed and moved into a decomposition drying section Z2 (see FIGS. 4 and 5). The moisture constituent contained in the wastes moved to the decomposition drying section Z2 is vaporized by the energy produced by decomposition of wastes in a decomposition reaction section Z3 which lies under the decomposition drying section Z2, whereby the wastes can be dried.

In order to decrease the volume of the decomposed portion of the underlying wastes, the wastes dried in the decomposition drying section Z2 is pressed and moved to the decomposition reaction section Z3. In the decomposition reaction section Z3, the wastes are decomposed by the heat of magnetic fields so that carbonization thereof is promoted. On the other hand, the carbonization of the wastes proceeds by the vibrations of magnetic fields.

Thereupon, the wastes having undergone carbonization becomes magnetized ceramic ash which is then accumulated in an ashed section Z4 which constitutes a first layer of the body 1, as shown in FIG. 5. The decomposition energy is accumulated in the ashed section Z4 so that the decomposition energy can act on the wastes existing in the overlying decomposition reaction section Z3 and decomposition drying section Z2 as described above.

The mixture of gas and vapor produced during the decomposition is discharged out of the body 1 through the gas outlets 12*b* which are defined through the upper portion of the sidewall 12 of the body 1, to be directed toward the filter. Also, magnetized liquid drops through holes defined in a baffle plate 13 and is discharged out of the body 1 through the liquid discharge pipes 15.

Ash accommodated in the ashed section Z4 is discharged by opening the covers of the discharge openings 12*c*.

As is apparent from the above description, in the present invention, since wastes are decomposed not by combustion in an incinerator but by using magnetic vibrations in a condition substantially having no oxygen, even when processing a chloride, the production of dioxin can be minimized.

Stating the functioning of the pressing means 2, because the wastes are pressed downward with an appropriate pressure by the weight member 20, the decomposition processing of the wastes can be promoted and a decomposition processing time can be shortened when compared to the case in which the wastes are not pressed downward. In particular, in the present embodiment of the invention, because the magnetic functioning means M is received in the pressing plate 21 which is always brought into direct contact with the wastes, it is possible to stably induce powerful magnetic fields in the wastes.

Although a preferred embodiment of the present invention his been described for illustrative purposes, those skilled in the art will appreciate that various modifications, additions and substitutions are possible, without departing from the scope and the spirit of the invention as disclosed in the accompanying claims. For example, while it was described in the aforementioned embodiment that the pressing means 2 automatically presses the wastes using the weight member 20, it can be envisaged that the design can be changed in a manner such that a pressing plate 21 having a relatively small weight is brought into direct contact with wastes by the medium of biasing means such as a coil spring or an air spring, to press the wastes. In this case, it is to be noted that the adjustment of biasing force of the biasing means falls under the scope of the present invention.

EXAMPLE

Comparison data between the waste decomposition apparatus according to the present invention and the conventional incinerator and melting furnace are given in Table 1.

The waste decomposition apparatus used in the present example has the diameter of about 1.5 m and the height of about 2.5 m. Of course, these sizes are only exemplary and may vary in conformity with the desire of a customer.

TABLE 1

| Comparison Items | Present Invention | Incinerator | Melting Furnace |
|---|---|---|---|
| Secondary combustion chamber | Unnecessary | Necessary | Necessary |
| Auxiliary fuel | Unnecessary | Necessary | Necessary |
| Furnace temperature | 300~350° C. | Over 800° C. | Over 1100° C. |
| Final ash amount (Optimum) | 0.50% | 5~10% | 2~5% |

Table 1 represents experimental comparison data in the waste decomposition apparatus according to the present invention and the conventional incinerator and melting furnace. From Table 1, it can be appreciated that, in the waste decomposition apparatus according to the present invention, the final ash amount of wastes is decreased to 0.50% compared to the volume of initially introduced wastes, and in the conventional incinerator and the melting furnace, the final ash amounts of wastes are decreased only to 5~10% and 2~5%, respectively. Accordingly, it is to e understood that the present invention is excellent in decreasing the volume of wastes. Specifically, in the present invention, because a second combustion chamber is not needed, facility costs can be reduced, and because an auxiliary fuel is not required, it is possible to process wastes at reduced costs.

In the waste decomposition apparatus according to the present invention, when compared to the conventional incinerator, facility costs can be reduced, running costs can be reduced, the production of dioxin is substantially prevented, and laws and regulations can be met, whereby the waste decomposition apparatus according to the present invention can be applied in various industrial fields that are accompanied by the production of wastes.

What is claimed is:

1. A waste decomposition apparatus comprising:

a container-shaped body with a cavity within said body;

a waste inlet through a wall of said container-shaped body into said cavity for introducing wastes into said cavity in the body;

an outlet from said cavity through a wall of said container-shaped body for discharging residual ash out of said cavity in the body after the wastes introduced into said cavity in the body are decomposed without the use of an auxiliary fuel;

magnetic material for inducing magnetic fields in the wastes introduced into said cavity in the body, said magnetic material being positioned on said waste decomposition apparatus;

a press for pressing the wastes introduced into said cavity in the body, said press being mounted in said cavity of said container-shaped body; and an air introduction pipe for introducing outside air into said cavity in said body and wherein said magnetic material for inducing magnetic fields comprises magnets installed on said air introduction pipe.

2. A waste decomposition apparatus wherein comprising:

a container-shaped body with a cavity within said body;

a waste inlet through a wall of said container-shaped body into said cavity for introducing wastes into said cavity in the body;

an outlet from said cavity through a wall of said container-shaped body for discharging residual ash out of said cavity in the body after the wastes introduced into said cavity in the body are decomposed without the use of an auxiliary fuel;

magnetic material for inducing magnetic fields in the wastes introduced into said cavity in the body, said magnetic material being positioned on said waste decomposition apparatus;

a press for pressing the wastes introduced into said cavity in the body, said press being mounted in said cavity of said container-shaped body;

wherein said press comprises a weight member which is disposed in said cavity in the body and means for raising and lowering the weight member; and wherein, said magnetic material for inducing magnetic fields further comprises magnets positioned in the weight member.

3. The waste decomposition apparatus according to claim 2, wherein the said magnets in the weight member comprise magnetized ash of wastes.

4. The waste decomposition apparatus according to claim 2 further comprising, an air introduction pipe for introducing outside air into said cavity in said body and wherein said magnetic material for inducing magnetic fields comprises magnets installed on said air introduction pipe.

5. The waste decomposition apparatus according to claim 2, further comprising magnets positioned in a space defined in a bottom of the body.

6. The waste decomposition apparatus according to claim 4, wherein said magnetic material for inducing magnetic fields further comprises magnetized ash of wastes positioned in a space defined in a bottom of the body.

7. The waste decomposition apparatus according to claim 2, further comprising magnets in the weight member.

8. The waste decomposition apparatus according to claim 4, further comprising magnets positioned in a space defined in a bottom of the body.

9. The waste decomposition apparatus according to claim 8, wherein said magnets positioned in the weight member and the bottom of the body comprise magnetized ash of wastes.

* * * * *